US005751900A

United States Patent [19]

Serizawa

[11] Patent Number: 5,751,900

[45] Date of Patent: May 12, 1998

[54] SPEECH PITCH LAG CODING APPARATUS AND METHOD

[75] Inventor: Masahiro Serizawa, Tokyo, Japan

[73] Assignee: NEC Corporation, Tokyo, Japan

[21] Appl. No.: 579,412

[22] Filed: Dec. 27, 1995

[30] Foreign Application Priority Data

Dec. 27, 1994 [JP] Japan ..... 6-324562

[51] Int. Cl.[6] ..... G10L 3/02

[52] U.S. Cl. ..... 395/2.16; 395/2.17; 395/2.31; 395/2.32

[58] Field of Search ..... 395/2.16, 2.17, 395/2.32, 2.31

[56] References Cited

U.S. PATENT DOCUMENTS 5,253,269 10/1993 Gerson et al. ..... 395/2.16

*Primary Examiner*—Allen R. MacDonald
*Assistant Examiner*—Robert Louis Sax
*Attorney, Agent, or Firm*—Foley & Lardner

[57] ABSTRACT

A pitch lag is extracted for each of a predetermined number of sub-frames. A predicted pitch lag for a pertinent sub-frame in the predetermined number of sub-frames is calculated on the basis of at least two pitch lags extracted for sub-frames other than the pertinent sub-frame or at least one pitch lag extracted for sub-frame other than the pertinent sub-frame and the preceding sub-frame by one sub-frame. A difference between the predicted pitch lag and the extracted pitch lag is then coded. Thus, an input speech signal pitch lag is coded for each sub-frame having a predetermined length.

13 Claims, 3 Drawing Sheets

FIG. 3(a)
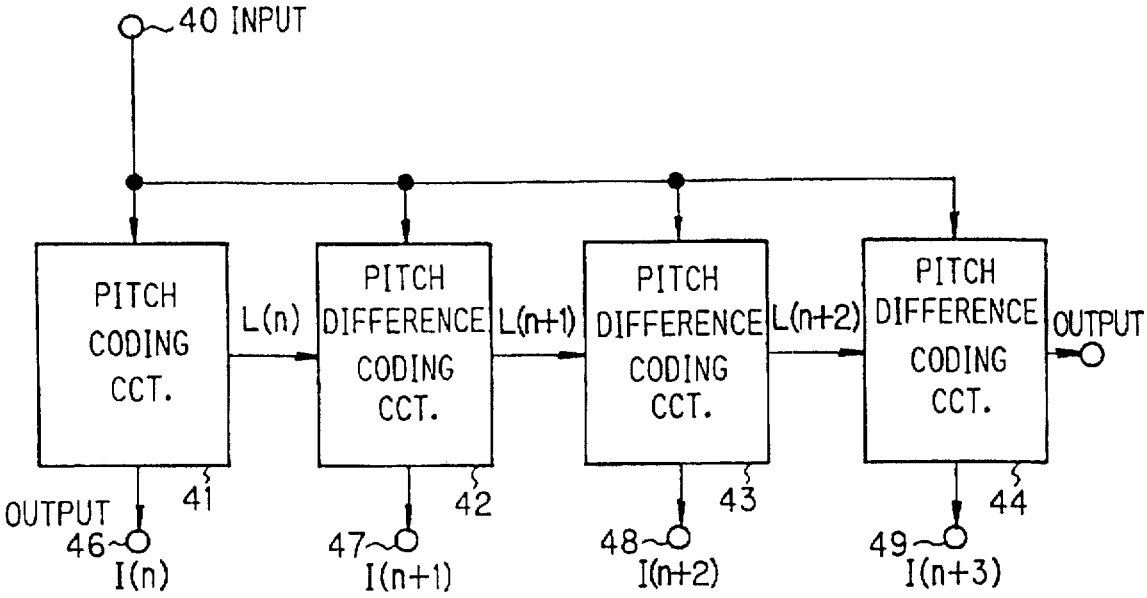
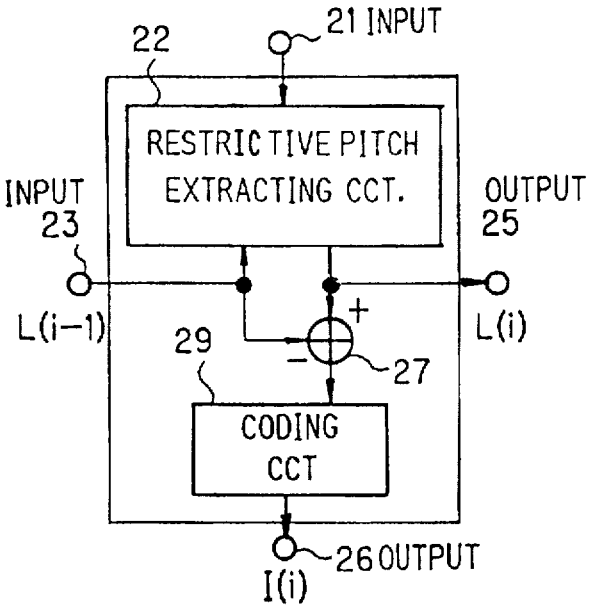
FIG. 3(b)
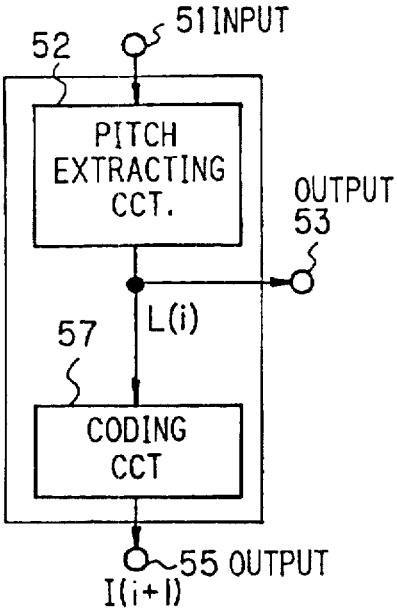
FIG. 3(c)

SPEECH PITCH LAG CODING APPARATUS AND METHOD

BACKGROUND OF THE INVENTION

The present invention relates to a speech pitch lag coding and, more particularly, to an apparatus and a method for speech pitch lag coding of CELP (Code Excited Linear Prediction Coding) type system.

The CELP system is a typical speech coding system using the speech pitch lag coding. In the CELP system, the speech coding is performed based on the feature parameters (spectral characteristics) obtained in a frame unit (for instance, 40 msec.) and feature parameters (pitch lag, excitation code, gain and the like) obtained in a sub-frame unit (for instance, 8 msec.), that is obtained by dividing the frame. The CELP system is disclosed in, for instance, M. Schroeder and B. Atal, "Code Excited Linear Prediction: High Quality Speech at Very Low Bit Rate", IEEE Proc. ICASSP-85, 1985, pp. 937–940 (Literature 1). The pitch lag described here corresponds to the pitch period of a speech signal, and the coded value is near an integral multiple or an integral division of the pitch period. This value is usually changed gradually with time.

Among the prior art methods of and apparatuses for pitch lag coding are those adopting a pitch lag difference coding system, which is based on the principle that the pitch period is changed gradually when the transmission bit rate is reduced. In the prior art method of and apparatus for pitch lag coding, the pitch lag is selected from the each sub-frame and the coding is performed by obtaining the difference from the preceding pitch lag. Examples of the prior art pitch lag coder are shown in U.S. Pat. No. 5,253,269 (Literature 2) and an invitation treatise by Ira A. Gerson, et. al, "Techniques for Improving the Performance of CELP-Type Speech Coders, IEEE J. Selected Areas in Communications, Vol. 10, No. 5, June 1992, pp. 858–865 (Literature 3). Now, an operation of coding the pitch lags of n-th to (n+3)-th sub-frames in a prior art pitch lag coder shown in FIGS. 3(*a*) to 3(*c*) will be described. It is assumed that B bits in each sub-frame are used for the coding.

The overall operation will first be described with reference to the FIG. 3(*a*) block diagram. A speech signal supplied to an input terminal 40 is provided to a pitch coder 41 and pitch difference coders 42 to 44. The pitch coder 41 extracts the pitch lag of the n-th sub-frame based on the speech signal from the input terminal 40 and supplies the extracted pitch lag to the pitch difference coder 42. In addition, the extracted pitch lag is coded and the index I(n) obtained as a result of the coding is supplied to an output terminal 46. The pitch difference coders 42 to 44 execute pitch difference coding with pitch lags L(i), i=n to n+2, from the respective preceding sub-frame pitch difference coders 41 to 43 and the input speech signal from the input terminal 40. The extracted pitch lags are supplied to the succeeding sub-frame pitch difference coders, and indexes I(i) obtained by coding the extracted pitch lags are supplied to output terminals 47 to 49. The indexes I(i), i=n to n+3, from the pitch coder 41 and the pitch difference coders 42 to 44 are thus supplied from the output terminals 46 to 49.

The operation of each pitch difference coder will now be described with reference to the FIG. 3(*b*) block diagram. An input speech from an input terminal 21 is supplied to a restrictive pitch extractor 22. Also, the pitch lag extracted in the (i−1)-th sub-frame is supplied from an input terminal 23 to the restrictive pitch extractor 22 and to a difference circuit 27. The restrictive pitch extractor 22 extracts the pitch lag of the pertinent sub-frame from the input speech. In the restrictive pitch extractor 22, the pitch lag is extracted from the range represented by coding bits B with the bases of the pitch lag extracted in the (i−1)th sub-frame. Then, the 1-st pitch lag L(i) obtained in the restrictive pitch extractor 22, is outputted from an output terminal 25 and also supplied to the difference circuit 27. The difference circuit 27 calculates the difference between the pitch lag extracted for the (i-1)th sub-frame from the input terminal 23 and the n-th pitch lag L(n) from the restrictive pitch extractor 22, and supplies the difference to a coder 29. The coder 29 codes the difference output from the difference circuit 27 with a predetermined number B of coding bits and supplies a code thus produced to an output terminal 26. Index I(i) from the coder 29 is thus outputted from the output terminal 26.

The operation of the pitch coder 41 will now be described with reference to the FIG. 3(*c*) block diagram. A pitch extractor 52, analyzing an input speech from an input terminal 51, extracts the pitch lag of the pertinent sub-frame and provides the extracted pitch lag to an output terminal 53 and a coder 57. The pitch lag L(i) from the pitch extractor 52 is outputted from an output terminal 53. The coder 57 then codes the pitch lag L(i) from the pitch extractor 52 and supplies index I(i) to an output terminal 55. The index I(i) from the coder 57 is outputted from the output terminal 55.

In the difference coding, when a transmission error is caused in the transmission line between the coder and decoder, an error is caused between the coded pitch lag in the coder and decoded pitch lag in the decoder, and this error is accumulated. In order to avoid this phenomena, the FIG. 3(*a*) prior art example employs the pitch coder 41 for transmitting a pitch lag, which is independent of the pitch lags in the past sub-frames, at a predetermined interval (for instance, the frame length).

As a pitch lag extraction method, there is an open-loop search method used in the CELP system. This method uses the correlation value between a vector x constituted by the pertinent sub-frame of input sub-frame and a vector x(L) which is obtained with the sub-frame length of the input speech signal preceding the pertinent sub-frame by L samples. The correlation value is calculated with respect to pitch lag L in a range which can be represented by the coding bits B noted above. Finally, the pitch lag L corresponding to the maximum correlation value is outputted as the pitch lag of the pertinent sub-frame. In this connection, there is a method based on a perceptually weighted input speech signal to suppress the quantization noise in a low power frequency range audible as noise to a person's ears.

The difference value R(n) from the difference circuit 27 can be expressed as:

$$R(n)=L(n)-L(n-1) \tag{1}$$

In the prior art method of and apparatus for speech pitch lag coding described above, the n-th sub-frame pitch lag is coded without use of the pitch lags of the preceding (n−2)th, (n−3)th, . . . and succeeding (n+1)th, (n+2)th, . . . sub-frames that are strongly correlated to the n-th sub-frame pitch lag. This means that there is a problem of failure of sufficient use, for the coding, of the character of a speech portion of a speech signal, in which pitch lags of a plurality of sub-frames are correlated to one another.

SUMMARY OF THE INVENTION

The present invention has an object of providing a method of and an apparatus for speech pitch lag coding, which permits high performance speech pitch lag coding with the same number of coding bits.

According to the present invention, there is provided a speech lag coding apparatus, in which an input speech signal pitch lag is coded for each sub-frame having a predetermined length, comprising: a first means for extracting a pitch lag for each of a predetermined number of sub-frames; a second means for calculating a predicted pitch lag for a pertinent sub-frame in the predetermined number of sub-frames on the basis of at least two pitch lags extracted for sub-frames other than the pertinent sub-frame or at least one pitch lag extracted for sub-frame other than the pertinent sub-frame and the preceding sub-frame by one sub-frame; and a third means for coding a difference between the predicted pitch lag obtained by the second means and the extracted pitch lag obtained by the first means.

The predicted pitch lag is calculated on the basis of the pitch lags extracted for a predetermined number of sub-frames including a predetermined number of preceding sub-frames and succeeding sub-frames of the pertinent sub-frame. The pitch lag for the pertinent sub-frame is extracted in the first means as a value in a range restricted by the predicted pitch lag obtained by the second means. The predicted pitch lag for the pertinent sub-frame is developed on the basis of a linear sum of the pitch lags for a plurality of other sub-frames than the current sub-frame. The coding is performed on the basis of the pitch lags for other group of sub-frames which does not include the pertinent sub-frame.

According to the present invention, there is provided a speech lag coding method in which an input speech signal pitch lag is coded for each sub-frame having a predetermined length, comprising the steps of: a first step for extracting a pitch lag for each of a predetermined number of sub-frames; a second step for calculating a predicted pitch lag for a pertinent sub-frame in the predetermined number of sub-frames on the basis of at least two pitch lags extracted for sub-frames other than the pertinent sub-frame or at least one pitch lag extracted for sub-frame other than the pertinent sub-frame and the preceding sub-frame by one sub-frame; and a third step for coding a difference between the predicted pitch lag and the extracted pitch lag.

Other objects and features will be clarified from the following description with reference to attached drawings.

BRIEF DESCRIPTION OF THE DRAWINGS

FIG. 3(*a*) to 3(*c*) show a prior art pitch lag coder, a pitch difference coder and a pitch coder in the pitch lag coder.

DETAILED DESCRIPTION OF THE PREFERRED EMBODIMENTS

In the present invention, the pitch lag of an n-th sub-frame is coded by predicting a pitch lag from the n-th sub-frame pitch lag and the pitch lags of preceding (n−1)th, (n−2)th, (n−3)th, . . . . and succeeding (n+1)-th, (n+2)-th, . . . sub-frames which are strongly correlated to the n-th sub-frame pitch lag)and coding the difference between the n-th sub-frame pitch lag and the predicted value.

In the present invention, an equation $$R(n)=L(n)-\text{func}[(\ldots, L(n-2),L(n-1), L(n+1),L(n+2), \ldots)] \quad (2)$$

may be employed, which corresponds to the above equation (1) used in the prior art. Here, [func( . . . , L(n−2),L(n−1), L(n+1),L(n+2) . . . )] means a function for predicting the pitch lag on the basis of the pitch lags for the . . . ,L(n−2),L(n−1),L(n+1), L(n+2) . . . th sub-frames and is a function of pitch lags L(i), (i=. . . ,n−1,n+1,n+2, . . . ). For example, an equation $$[\text{func}(\ldots,L(n-2),L(n-1),L(n+1),L(n+1)\ldots)]=$$

$$[\mathit{func}(\ldots,L(n-2),L(n-1),L(n+1),L(n+2)\ldots)]=\sum_{i=1}^{S} L(n-i)*N(n-i) \quad (3)$$

to be a predetermined weighting value or different values for each different sub-frame. S is an integral value. Equation (3) means that the pitch lag for the n-th sub-frame of a particular frame is expressed by the linear summation of the other weighted pitch lags for the other sub-frames of the same frame.

For example, assuming that there are four sub-frames per frame, the function for predicting the pitch lag of the third sub-frame can be expressed by:

$$\text{func}[L(1),L(2),L(4)]=L(1)*N(1)+L(2)*N(2)+L(4)*N(4)$$

From this, one can obtain:

$$R(3)=L(3)-\text{func}[L(1),L(2),L(4)].$$

An operation example of obtaining pitch lags according to the present invention, will now be described with reference to FIG. 2, which is a graph showing the correlation between sub-frame number and pitch lag value. In the graph, the ordinate is taken for pitch lag value and the abscissa for sub-frame number. The dotted lines 31A to 31E show actual pitch periods of individual sub-frames. These actual pitches are indefinite before the coding, but they are assumed to be known for the sake of the description. The solid lines 30A to 30C show pitch lags obtained with the coding apparatus according to the present invention. The broken line shows the predicted pitch lag according to the present invention.

Figure 2:
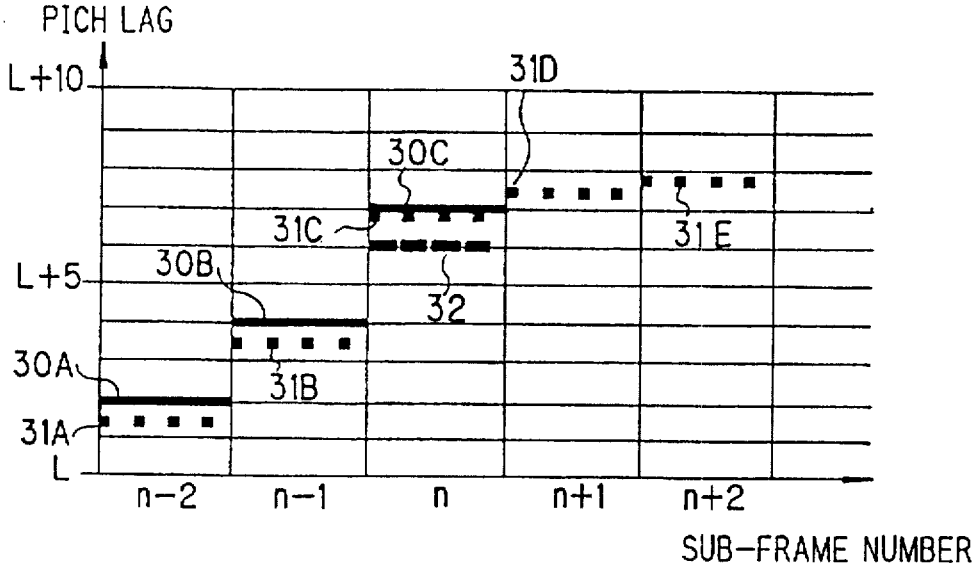
FIG. 2 shows a graph representing the correlation between sub-frame number and pitch lag value, the ordinate being taken for pitch lag value, and the abscissa for sub-frame number.

The graph of FIG. 2 shows a case where the pitch lag varies comparatively linearly. As described before, the pitch lag of speech varies comparatively gently. A prediction model is now considered, which is given as:

$$[\text{func}(\ldots,L(n-2),L(n-1),L(n+1),L(n+2)\ldots)]=L(n-1)*N(1)+L(n-2)*N(2) \quad (4)$$

Assuming linear pitch lag change, L(n) is obtained by the extrapolation calculation on the basis of the pitch lags L(n−1) and L(n−2). N(1)=12, and N(2)=−1. Alternatively, as shown in FIG. 2, the pitch lags L(n−1) and L(n−2) for the (n−1)th and (n−2)th sub-frames are L+4 and L+2, respectively. Consequently, the pitch lag for the n-th sub-frame is expressed by:

$$[\text{func}(\ldots,L(n-2),L(n-1),L(n+1),L(n+2)\ldots)]=L(n-2)*N(2)+L(n-1)*N(1)=(L+2)*(-1)+(L+4)*2=L+6.$$

Using the equation (4), the difference R(n) is $$R(n)=(L+7)-(L+6)=1.$$

On the other hand, in the prior art example expressed by the equation (1)

$$R(n)=(L+7)-(L+4)=3.$$

According to the present invention, it is possible to improve the accuracy of the pitch lag of the next sub-frame as a reference of the difference, and the difference can be reduced compared to the prior art. That is, according to the present invention, it is possible to reduce the number of necessary bits for coding compared to the prior art.

When the difference is large, the prediction according to the equation (4) may be inadequate. In such a case, the prior art method may be used for further improving the performance.

As shown, the method of and apparatus for pitch lag coding permit accuracy improvement of the predicted pitch lag of the pertinent sub-frame, thus permitting reduction of the number of bits necessary for coding compared to the prior art method. In addition, high performance coding compared to the prior art method is obtainable with the same number of bits.

Figure 1A:
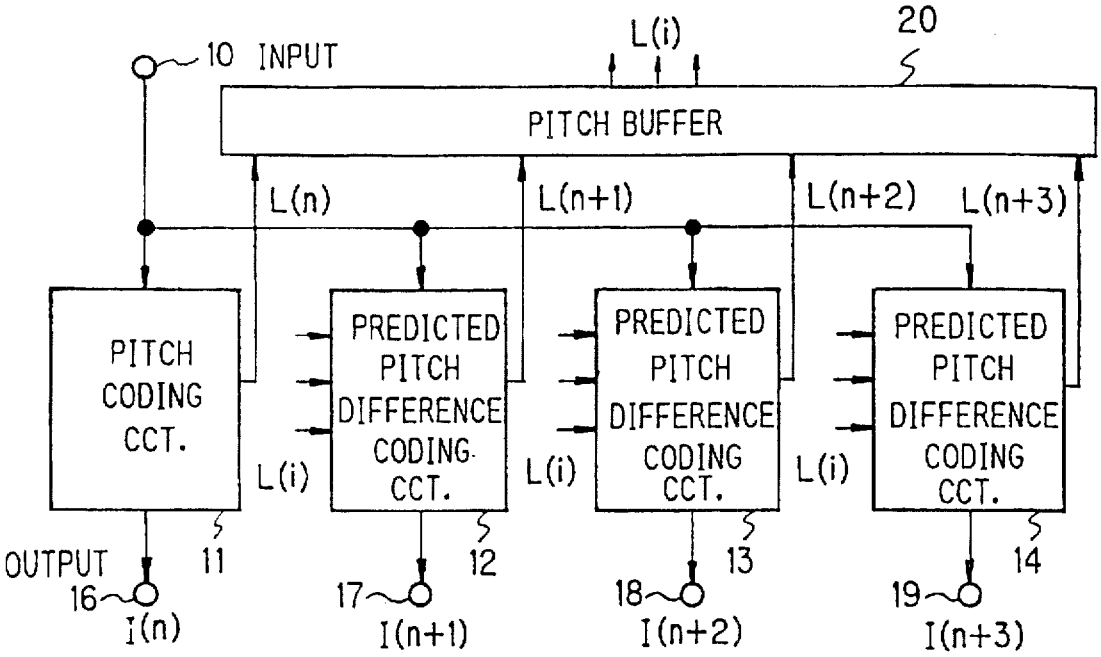
FIGS. 1(*a*) to 1(*c*) show a pitch lag coder according to an embodiment of the present invention, a pitch difference coder and a pitch coder in the embodiment.
Figure 1B:
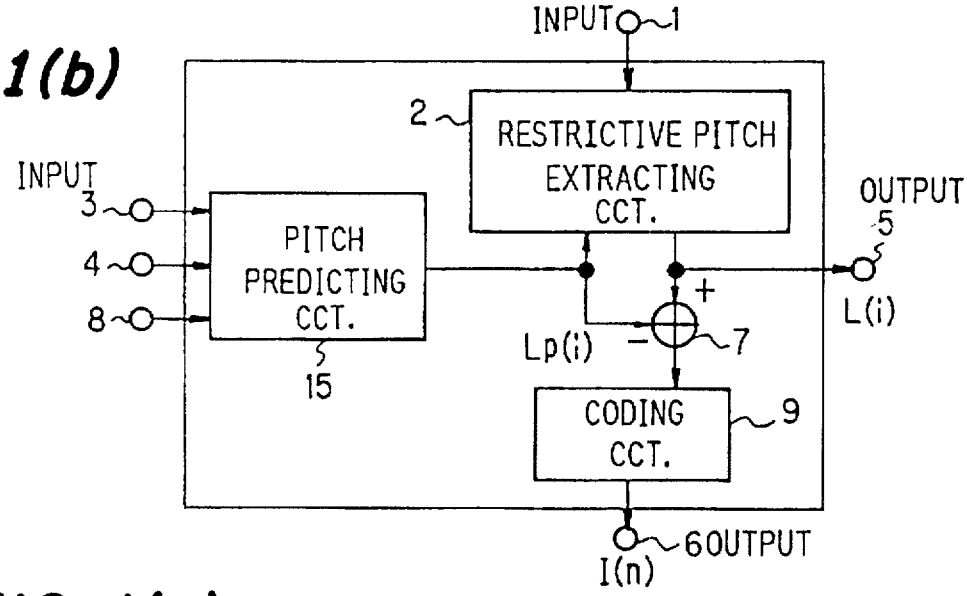
Figure 1C:
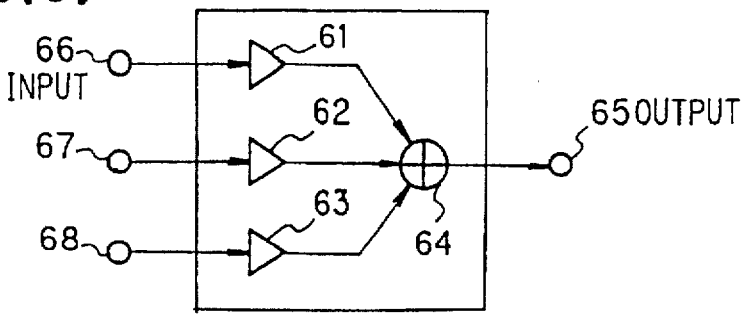

The block diagrams of FIGS. 1(*a*) to 1(*c*) show an embodiment of the apparatus according to the present invention.

The illustrated embodiment of the present invention is a speech pitch lag coding apparatus 100, which comprises an input terminal 10, a pitch buffer 20, a pitch coding circuit 11, predicted pitch difference coding circuits 12 to 14 and a pitch buffer 20. A speech signal comprising n-th to (n+3)-th sub-frames is input to the supplied terminal 10. The pitch buffer 20 stores pitch lags outputted from the four coding circuits and collectively outputs the four pitch lags as parallel data. The pitch coding circuit 11, which is connected to the input terminal 10, extracts the pitch lag of the first (i.e., n-th) one of the four sub-frames and supplies the extracted pitch lag to the pitch buffer 20, while supplying an index. The predicted pitch difference coding circuits 12 to 14 respectively extract the pitch lags of the (n+1)th to (n+3)-th sub-frames received from the input terminal 10 and supply the extracted pitch lags to the pitch buffer 20. In addition, the circuits 12 to 14 each receive a plurality of pitch lags except for the own provided pitch lag from the pitch buffer 20, derive a predicted pitch lag of the own received sub-frame, code the difference between the derived predicted pitch lag and own provided pitch lag, and provide the coded data as index. B bits are used for each sub-frame coding.

A speech signal inputted to the input terminal 10 is supplied to the pitch coding circuit 11 and predicted pitch difference coding circuits 12 to 14. The pitch coding circuit 11 extracts the pitch lag of the n-th sub-frame by using the speech signal from the input terminal 10 and supplies the extracted pitch lag to the pitch buffer 20. The pitch coding circuit 11 also codes the extracted pitch lag and supplies index I(n) thus obtained to an output terminal 16. The predicted pitch difference coding circuits 12 to 14 execute predicted pitch difference coding by using respective other sub-frame pitch lags supplied from the pitch buffer 20 and the input speech signal from the input terminal 10, and supply the extracted pitch lag to the other ones of them for the other sub-frames and indexes I(i), i=n+1 to n+3, to respective output terminals 17 to 19. The pitch buffer 20 stores the sub-frame pitch lags provided from the various coding circuits 11 to 14 and supplies the stored pitch lags to the predicted pitch difference coding circuits 12 to 14. The indexes I(i), i=n to n+3, supplied from the various coding circuits 11 to 14, are outputted from the output terminals 16 to 19.

The operation of the pitch coding circuit 11 is the same as that of the pitch coding circuit 41 in the prior art pitch lag coding circuit described before and not described here repeatedly.

The operation of each predicted pitch difference coding circuit will now be described with reference to the FIG. 1(*b*) block diagram.

A plurality of pitch lags L(i) inputted from the other sub-frames are supplied to input terminals 3, 4 and 8. A pitch predicting circuit 15 calculates a predicted pitch lag Lp(i) of the own sub-frame by using the pitch lags L(i) from the input terminals 3, 4 and 8, and supplies the predicted pitch lag Lp(i) thus calculated to the restrictive pitch extracting circuit 2 and the difference circuit 7. The restrictive pitch extracting circuit 2 extracts the pitch lag of the own sub-frame in the input speech signal from the input terminal 1. It extracts the pitch lag with the predicted pitch lag Lp(i) as reference and in a range expressed by B coding bits. The method of pitch lag extraction is the same as described before in connection with the prior art method and not described here repeatedly.

The own sub-frame pitch lag L(i) extracted in the restrictive pitch extracting circuit 2 is outputted from an output terminal 5 and supplied to the difference circuit 7. The difference circuit 7 calculates the difference between the predicted pitch lag provided from the pitch predicting circuit 15 and the pitch lag from the restrictive pitch extracting circuit 2, and supplies this difference to a coding circuit. The coding circuit 9 codes the difference supplied form the difference circuit 7 with a predetermined number of, i.e., B, coding bits and supplies an index I(i) thus obtained to an output terminal 6. The index I(i) from the coding circuit 9 is thus outputted from the output terminal 6.

The operation of the pitch predicting circuit in FIG. 1(*b*) will now be described with reference to the FIG. 1(*c*) block diagram.

A plurality (i.e., three in this embodiment) of pitch lags from input terminals 66 to 68 are supplied to multiplying circuits 61 to 63. The multiplying circuits 61 to 63 multiply the pitch lags from the input terminals 66 to 69 by a predetermined coefficient and supplies the products thus obtained to an adder 64. The adder 64 together the products from the multiplying circuits 61 to 63 and supplies thus obtained sum to an output terminal 65. The sum from the adder 64 is outputted from the output terminal 65.

In order to avoid the error accumulation, the coding may be performed on the basis of the pitch lags for other group of sub-frames which does not include the pertinent sub-frame.

As has been described in the foregoing, according to the present invention, a series of sub-frames are received successively, the pitch lags of the received sub-frames are extracted, a predicted pitch lag of each of the received sub-frames is calculated by using one of the extracted pitches, and the difference between the predicted pitch lag and each of the extracted pitch lags is coded. It is thus possible to obtain high performance speech pitch lag coding with the same number of coding bits as in the prior art.

Changes in construction will occur to those skilled in the art and various apparently different modifications and embodiments may be made without departing from the scope of the invention. The matter set forth in the foregoing description and accompanying drawings is offered by way of illustration only. It is therefore intended that the foregoing description be regarded as illustrative rather than limiting.

What is claimed is:

1. A speech lag coding apparatus, in which an input speech signal pitch lag is coded for each sub-frame having a predetermined length, comprising:

a first means for extracting a pitch lag for each of a predetermined number of sub-frames;

a second means for calculating a predicted pitch lag for a pertinent sub-frame in the predetermined number of sub-frames on the basis of at least two pitch lags extracted for sub-frames other than the pertinent sub-frame; and a third means for coding a difference between the predicted pitch lag obtained by the second means and the extracted pitch lag obtained by the first means.

2. The speech pitch lag coding apparatus as set forth in claim 1, wherein the predicted pitch lag is calculated on the basis of the pitch lags extracted for a predetermined number of sub-frames including a predetermined number of preceding sub-frames and succeeding sub-frames with respect to the pertinent sub-frame.

3. The speech pitch lag coding apparatus as set forth in claim 1, wherein the pitch lag for the pertinent sub-frame is extracted in the first means as a value in a range restricted by the predicted pitch lag obtained by the second means.

4. The speech pitch lag coding apparatus as set forth in 1, wherein the predicted pitch lag for the pertinent sub-frame is developed on the basis of a linear sum of the pitch lags for a plurality of sub-frames other than the pertinent sub-frame.

5. The speech pitch lag coding apparatus as set forth in 1, wherein the coding is performed on the basis of the pitch lags for other group of sub-frames which does not include the pertinent sub-frame.

6. A speech lag coding apparatus, in which an input speech signal pitch lag is coded for each sub-frame having a predetermined length, comprising:

a first means for extracting a pitch lag for each of a predetermined number of sub-frames;

a second means for calculating a predicted pitch lag for a pertinent sub-frame in the predetermined number of sub-frames on the basis of at least one pitch lag extracted from one sub-frame other than the pertinent sub-frame and an adjacent sub-frame with respect to the one sub-frame, the adjacent sub-frame not corresponding to the pertinent sub-frame; and a third means coding a difference between the predicted pitch lag obtained by the second means and the extracted pitch lag obtained by the first means.

7. The speech pitch lag coding apparatus as set forth in claim 6, wherein the predicted pitch lag is calculated on the basis of the pitch lags extracted for a predetermined number of sub-frames including a predetermined number of preceding sub-frames and succeeding sub-frames with respect to the pertinent sub-frame.

8. The speech pitch lag coding apparatus as set forth in claim 6, wherein the pitch lag for the pertinent sub-frame is extracted in the first means as a value in a range restricted by the predicted pitch lag obtained by the second means.

9. The speech pitch lag coding apparatus as set forth in 6, wherein the predicted pitch lag for the pertinent sub-frame is developed on the basis of a linear sum of the pitch lags for a plurality of sub-frames other than the pertinent sub-frame.

10. The speech pitch lag coding apparatus as set forth in 6, wherein the coding is performed on the basis of the pitch lags for other group of sub-frames which does not include the pertinent sub-frame.

11. A method of a speech lag coding in which an input speech signal pitch lag is coded for each sub-frame having a predetermined length, comprising the steps of:

a first step for extracting a pitch lag for each of a predetermined number of sub-frames;

a second step for calculating a predicted pitch lag for a pertinent sub-frame in the predetermined number of sub-frames on the basis of at least two pitch lags extracted for sub-frames other than the pertinent sub-frame; and a third step for coding a difference between the predicted pitch lag and the extracted pitch lag.

12. A method of a speech lag coding in which an input speech signal pitch lag is coded for each sub-frame having a predetermined length, comprising the steps of:

extracting a pitch lag for each of a predetermined number of sub-frames;

calculating a predicted pitch lag for a pertinent sub-frame in the predetermined number of sub-frames on the basis of at least two pitch lags extracted for sub-frames other than the pertinent sub-frame or at least one pitch lag extracted for one sub-frame other than the pertinent sub-frame and an adjacent sub-frame with respect to the one sub-frame, the adjacent sub-frame not corresponding to the pertinent sub-frame; and coding a difference between the predicted pitch lag and the extracted pitch lag.

13. A method as set forth in claim 11, wherein one of the sub-frames other than the pertinent sub-frame used in the second step is a sub-frame previous in time to the pertinent sub-frame, and wherein another of the sub-frames other than the pertinent sub-frame used in the second step is a sub-frame subsequent in time to the pertinent sub-frame.

* * * * *